United States Patent [19]

Baker

[11] 4,293,993

[45] Oct. 13, 1981

[54] TOOL FOR REMOVING CASEMENT WINDOW FROM BUILDING

[76] Inventor: James A. Baker, P.O. Box 71, Dunkirk, Md. 20754

[21] Appl. No.: 39,379

[22] Filed: May 16, 1979

[51] Int. Cl.[3] ..... B26B 27/14

[52] U.S. Cl. ..... 29/278

[58] Field of Search ..... 29/270, 278, 281.1, 29/281.5, 266; 269/244, 107, 153, 97, 101, 104, 110; 248/226.1; 24/263 A

[56] References Cited

U.S. PATENT DOCUMENTS

| | | | |
|---|---|---|---|
| 1,151,959 | 8/1915 | McKenzie | 269/244 |
| 2,043,140 | 6/1936 | Wilmesherr | 269/244 |
| 2,235,953 | 3/1941 | Whitfield | 29/266 |
| 3,469,299 | 9/1969 | Rogers | 29/281.5 |

*Primary Examiner*—James L. Jones, Jr.

*Attorney, Agent, or Firm*—William D. Johnston, III

[57] ABSTRACT

A tool for removing casement windows comprises a first bar bearing on the interior side of the main frame, a second bar bearing on the exterior vertical surfaces of the building, and apparatus connecting the two bars for controllably pulling the window toward the exterior of the building to free it from a retaining frame embedded in the wall of the building.

4 Claims, 3 Drawing Figures

FIG. 1.
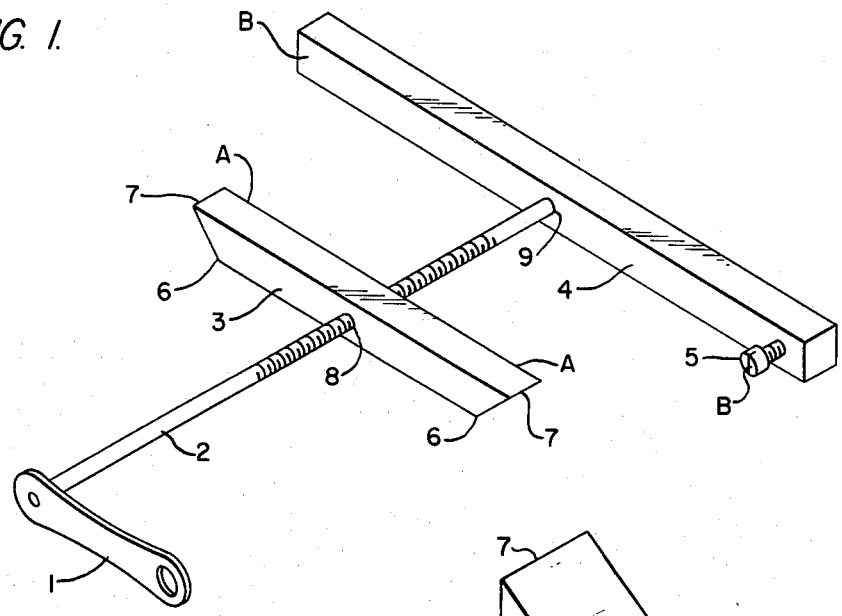
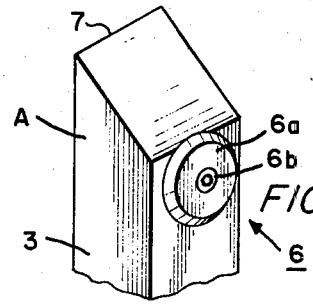
FIG. 3.
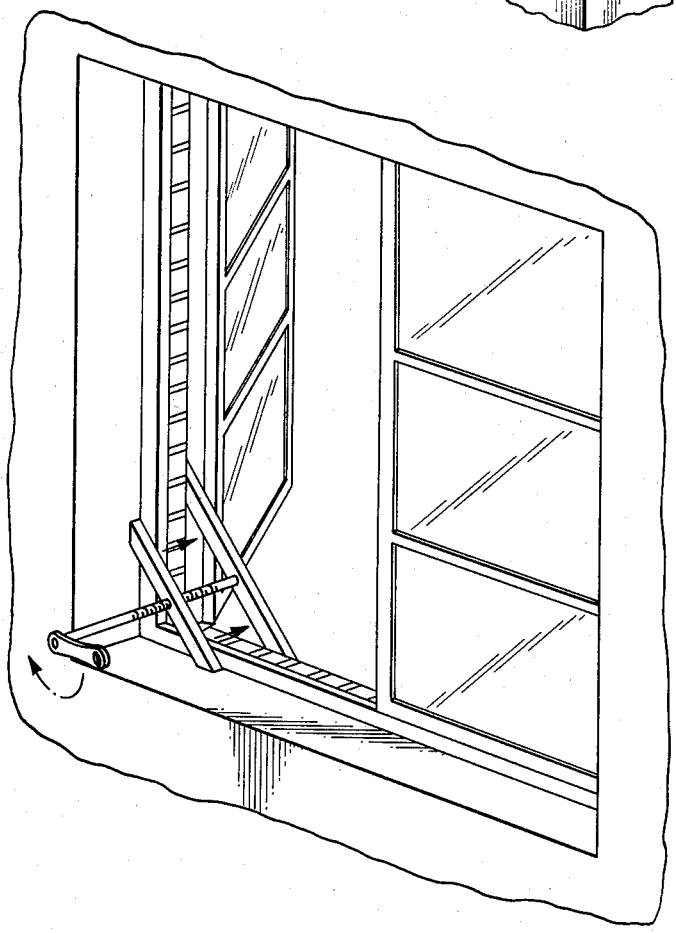
FIG. 2.

TOOL FOR REMOVING CASEMENT WINDOW FROM BUILDING

BACKGROUND OF THE INVENTION

1. Field of the Invention

This tool is useful in removing the common steel frame type casement windows, for instance for replacement with more modern window units.

2. Description of the Prior Art

In prior times, a steel frame type of casement window was commonly used in buildings. This window unit generally comprised a steel frame containing glass window panels, one or more of which often had its own steel frame so that it could be opened and closed with a crank or other means.

These generally rectangular casement windows are usually permanently built into the wall opening with the main frame of the casement window being contained at the interior side of the wall by another steel frame of slightly smaller rectangular proportion that is embedded within the building wall. From the interior side, these casement windows are generally contained by the plaster interior sill and wall sides of the window opening. In replacing these casement type windows with windows having more advantageous features for easier cleaning, lower heat loss, etc., it thus is nearly always necessary to force the main frame of the window outward past the frame embedded in the wall. The embedded frame generally has an inside clearance that is slightly smaller than the outside dimensions of the portion of the main frame of the casement window which is held by the embedded frame.

Therefore it is necessary to exert considerable force on the casement window main frame, to force it outward past the embedded frame. The main frame of the casement window is to some extent distorted from this forcing of a portion of the main frame past the embedded frame. Generally the negative clearance between the two is relatively small, the relative proportions having been disigned merely to ensure containing the casement window against the forces usually encountered by a window unit. Thus an elastic distortion is usually sufficient for springing the casement unit outward past the embedded frame that contains it.

The tools that are generally used in this operation include a variety of the most common type of tool. This includes the hammer, chisel, screwdriver, prying bar, etc. These typically result in more than elastic distortion of the casement window, in damage to the interior wall and sill portions adjacent the casement window, and the exterior portions of the exterior wall and sill are also frequently damaged. Use of these basic tools usually requires considerable exertion and repeated attempts to gain the necessary mechanical advantage to force the casement unit outward past the embedded frame.

Use of such tools generally requires, or at least results in, considerable breakage of the glass panels in the casement window unit being removed. This is potentially quite dangerous for the workmen removing the window, and further results in broken glass at the job site.

SUMMARY OF THE INVENTION

A purpose of the present invention is to provide a tool for controllably applying the force necessary to remove casement windows.

Another purpose of the present invention is to provide a tool that allows easy removal of casement windows without damage to adjoining portions of the building.

Another purpose of the present invention is to provide a tool for safely removing casement windows with the glass panels intact and without damage to the adjoining wall and sill portions.

Another purpose of the present invention is to allow removal of casement type window units in a more efficient and safer manner.

Another purpose of the present invention is to improve the service of removing casement windows, as for replacement with more modern units, etc.

DESCRIPTION OF THE PREFERRED EMBODIMENTS

FIG. 1 shows one embodiment of an assembled tool of the present invention.

FIG. 2 shows the tool inserted in an opened window panel of the casement window in one corner of the casement unit.

FIG. 3 shows brass roller *6a* mounted for rotation on screw *6b*.

A handle 1 may be a removable rachet attachable to the end of a threaded rod 2 for turning the rod 2 for advancing the rod in threaded hole 8 of bar 3. The rod 2 may be threaded into a brass bushing rotatably held inside the unthreaded hole 9 of bar 4, or bar 4 may comprise other means allowing the bar 2 to rotate while holding the rod 2 within the hole 9, for example, such as by retaining means not shown on a portion of rod 2 extending through hole 9 beyond bar 4.

Bar 3 may have bevelled edges 7, and non-mar brass rollers or buttons 6. FIG. 3 shows brass roller *6a* mounted for rotation on screw *6b*. Surface A at each end of bar 3 bears against the inside surface of the main frame of the casement window to be removed, in the direction of the arrows as shown in FIG. 2. Bar 4 has at each end a surface B for bearing against the outside wall and sill, in the direction of which the casement window is to be pulled by the surface A of bar 3 when handle 1 is turned to advance the threaded rod 2 in hole 8 while rotating without translation in hole 9. As FIG. 2 shows, the beveled edges 7 of bar 3 allow bar 3 to have greater and more even bearing against the main frame of the casement window being removed. The no-mar rollers or buttons 6 (not shown) are to protect the interior wall and sill from damage during use of the tool.

The bolt 5 is adjustable or removable for compensation if the exterior sill projects out beyond the vertical surface of the exterior wall. Alternately the connection of rod 2 to bar 4 for holding the turning rod 2 includes swivel means for allowing bar 4 to rotate slightly from its transverse orientation with rod 2 to accomodate itself to any such difference between the vertical surface of the exterior wall and exterior sill.

As shown in FIG. 2, the tool is inserted in an opened window panel of the casement window in one corner of the casement unit. Operation of the tool at one such corner is generally sufficient for removing the entire casement window whose configurations generally include at least one such openable window panel at least at one end of the casement window. If no openable window panel is available at an end of the casement window, then one section of glass needs merely to be removed for use of the tool.

The tool and method for its use allows the controlled application of sufficient force to push the casement window out for its easy and intact removal. The service is performed easily without damage to the interior or exterior portions of the wall or sill. This avoids the necessity of replastering and repainting interior portions of the wall which often involves the difficult task of matching the color to old paint. The deformation of the casement window in forcing it past the embedded frame is generally such that none of the glass panels are broken to fall around the job site. This also saves clean up time. The controlled application of force for removing the casement window presents considerably less risk to the workmen in removing the window as compared to the usual methods. The entire service to the customer is rendered in a much more professional manner.

Various modifications in the present invention will be obvious to one skilled in the art.

What is claimed is:

1. A tool for removing a casement window from the wall of a building, said casement window comprising a first frame containing the glass of said casement window, said first frame being contained in said wall by a second frame embedded in said wall, said tool comprising:

a first bar for bearing on the exterior vertical portion of the wall and on the vertical portion of the sill of the window adjacent to a selected corner of the window;

a second bar for bearing on interior portions of said first frame of said selected corner of said casement window, said second bar being shorter than said first bar, and said second bar having bevelled ends for bearing on vertical and horizontal portions of said first frame adjacent to said selected corner of said window;

a threaded rod connecting said first and second bars for controllably applying a force to pull said first and second bars together to move the corner of said first frame corresponding to said selected corner of said casement window past said embedded second frame towards the exterior of said building;

said first and second bars and said threaded rod comprising means for advancing said threaded rod within a selected one of said first and second bars upon rotation of said threaded rod, and for preventing the advancement while allowing the rotation of the threaded rod within the other of said first and second bars upon said rotation of said threaded rod, and for allowing at least one of said bars to rotate in a direction towards said threaded rod during said removal of said casement window; and no-mar means mounted at each said end of said second bar for protecting the interior portions of said wall and sill adjacent to said selected corner of said casement window while said tool operates to move said second frame through said first frame.

2. The tool of claim 1, comprising means for compensation between said exterior sill and wall vertical portions of said building when said exterior vertical portions of said building project to different distances away from said casement window, said compensation means being comprised at one end of said first bar.

3. The tool of claim 1, said no-mar means comprising a roller attached at each said end of said second bar.

4. The tool of claim 1, said no-mar means comprising a button attached at each said end of said second bar.

* * * * *